US008646422B2

(12) United States Patent
Choi et al.

(10) Patent No.: US 8,646,422 B2
(45) Date of Patent: Feb. 11, 2014

(54) ELECTRO-HYDRAULIC VARIABLE VALVE LIFT APPARATUS

(75) Inventors: Byong Young Choi, Incheon-si (KR); Jin Kook Kong, Suwon-si (KR); Soo Hyung Woo, Yongin-si (KR); Jin Soon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 490 days.

(21) Appl. No.: 12/957,249

(22) Filed: Nov. 30, 2010

(65) Prior Publication Data

US 2012/0042840 A1 Feb. 23, 2012

(30) Foreign Application Priority Data

Aug. 20, 2010 (KR) ..... 10-2010-0080989

(51) Int. Cl.
*F01L 9/04* (2006.01)

(52) U.S. Cl.
USPC ..... 123/90.11; 123/90.16; 123/90.57; 123/90.12

(58) Field of Classification Search
USPC ..... 123/90.16, 90.57, 90.11, 90.12, 90.15, 123/90.55, 90.56
See application file for complete search history.

(56) References Cited

U.S. PATENT DOCUMENTS 4,765,288 A * 8/1988 Linder et al. ..... 123/90.16
5,088,458 A * 2/1992 Wakeman et al. ..... 123/90.55
5,113,812 A * 5/1992 Rembold et al. ..... 123/90.12
5,263,441 A * 11/1993 Rembold et al. ..... 123/90.12
5,373,817 A * 12/1994 Schechter et al. ..... 123/90.12
5,682,846 A * 11/1997 Scharnweber ..... 123/90.12
5,829,397 A * 11/1998 Vorih et al. ..... 123/90.12
6,053,136 A * 4/2000 Albanello et al. ..... 123/90.16
6,135,073 A * 10/2000 Feucht et al. ..... 123/90.12
6,516,760 B2 * 2/2003 Buglioni ..... 123/90.16
6,520,129 B2 * 2/2003 Chiappini et al. ..... 123/90.12
6,530,350 B2 * 3/2003 Chiappini et al. ..... 123/90.12
6,814,052 B2 * 11/2004 Weiss et al. ..... 123/350
6,901,896 B2 * 6/2005 Yamamoto et al. ..... 123/90.45
6,959,675 B2 * 11/2005 Nagano et al. ..... 123/90.16
7,509,933 B2 * 3/2009 Dingle ..... 123/90.52
8,215,276 B2 * 7/2012 Hendriksma ..... 123/90.52
8,225,769 B2 * 7/2012 Dilly ..... 123/321

* cited by examiner

*Primary Examiner* — Thomas Denion
*Assistant Examiner* — Thomas Olszewski
(74) *Attorney, Agent, or Firm* — Morgan, Lewis & Bockius LLP

(57) ABSTRACT

An electro-hydraulic variable valve lift apparatus includes a housing, a driving cam, a pump piston which forms a main chamber with the housing, reciprocates within the housing according to rotation of the driving cam, and forms hydraulic pressure within the main chamber, a pump piston elastic portion disposed for elastically supporting the pump piston, an oil pressure controller communicating with the main chamber in order to control hydraulic pressure within the main chamber, a hydraulic piston slidably disposed within the housing, includes a first body having a first diameter and a second body having a second diameter larger than the first diameter, and is connected with a valve, and a piston guide disposed between the housing and the hydraulic piston for guiding the hydraulic piston.

10 Claims, 11 Drawing Sheets

| | High Lift Long Duration | High/Middle Ligt Long/Middle Duration | Low Lift Short Duration | Valve Deactivation |
|---|---|---|---|---|
| valve profile |  |  |  |  |
| driving range | high load | middle load | low load | CDA |
| oil drain time | non | top position of cam lobe (A) | before top position of cam lobe (B) | always |
| forming ramp | Open/close cam lobe ramp profile | Open: cam lobe close: hydraulic pressure | ↓ | non |

ELECTRO-HYDRAULIC VARIABLE VALVE LIFT APPARATUS

CROSS-REFERENCE TO RELATED APPLICATION

This application claims priority to and the benefit of Korean Patent Application No. 10-2010-0080989 filed in the Korean Intellectual Property Office on Aug. 20, 2010, the entire contents of which application is incorporated herein for all purposes by this reference.

BACKGROUND OF THE INVENTION

1. Field of the Invention

The present invention relates to a valve lift apparatus. More particularly, the present invention relates to an electro-hydraulic variable valve lift apparatus for an internal combustion engine.

2. Description of the Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various research has been undertaken. For example, a valve for driving a valve is designed having different shapes, a variable valve lift apparatus has variable different lifts depending on an engine speed and so on.

However, since a CVVL (continuous variable valve lift apparatus) which is controlled mechanically, uses a link, eccentric cam a control shaft and so on, so that moment of inertia and accumulated clearance is relatively large, and development of dynamic characteristic of a valve is limited.

Also, each valve is controlled by the same camshaft simultaneously, realizing valve lift is limited.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

Various aspects of the present invention have been made in an effort to provide an electro-hydraulic variable valve lift apparatus which may adjust valve lift according to engine operation condition.

An electro-hydraulic variable valve lift apparatus according to various aspects of the present invention may form ramp profile when a valve is closed so as to reduce valve closing impact.

An electro-hydraulic variable valve lift apparatus according to various aspects of the present invention may be provided with a piston guide so that accurate operation may be realized regardless clearance generated in manufacturing process.

An electro-hydraulic variable valve lift apparatus according to various aspects of the present invention may include a housing, a driving cam, a pump piston which forms a main chamber with the housing, reciprocates within the housing according to rotation of the driving cam, and forms hydraulic pressure within the main chamber, a pump piston elastic portion which is disposed for elastically supporting the pump piston, an oil pressure controller which is communicated with the main chamber in order to control hydraulic pressure within the main chamber, a hydraulic piston which is slidably disposed within the housing, includes a first body having a first diameter and a second body having a second diameter larger than the first diameter, and is connected with a valve, and a piston guide which is disposed between the housing and the hydraulic piston for guiding the hydraulic piston.

The piston guide may be disposed between the first body and the housing, the first body and the housing may form a first auxiliary chamber, and the second body, the housing and the piston guide may form a second auxiliary chamber, wherein the first body may include a first hydraulic line selectively connecting the first auxiliary chamber and the second auxiliary chamber, and a second hydraulic line connecting the first auxiliary chamber and the second auxiliary chamber.

The first hydraulic line may be closed by the piston guide when the valve is closed.

The second body may be provided with a hydraulic pressure valve lash adjuster for adjusting a gap of the valve.

The hydraulic pressure valve lash adjuster may include a low pressure chamber formed in the second body, a lash adjusting hydraulic pressure line formed in the housing, a low pressure chamber hydraulic pressure supply line formed in the second body for connecting the low pressure chamber and the lash adjusting hydraulic pressure line, a lash adjuster housing forming high pressure chamber with the second body and connected with the valve, a lash adjuster spring which is disposed between the lash adjuster housing and the second body and elastically supports the lash adjuster housing, a communicating hole communicating the low pressure chamber with the high pressure chamber, a one-way valve which is disposed within the lash adjuster housing and selectively closes the communicating hole, and a one-way valve spring elastically supporting the one-way valve.

The second body may be provided with a mechanical valve lash adjuster for adjusting a gap of the valve.

A swing arm may be disposed between the driving cam and the pump piston, and the pump piston reciprocates by the swing arm.

The main chamber and the first auxiliary chamber may be communicated with by a hydraulic pump hydraulic pressure line.

Reciprocal motion directions of the pump piston and the hydraulic piston may not be parallel each other.

The first auxiliary chamber and the second auxiliary chamber may be connected by a connecting hydraulic line, and a differential pressure valve may be disposed on the connecting hydraulic line.

The piston guide may be disposed between the second body and the housing, the first body and the housing may form a first auxiliary chamber, and the second body, the housing and the piston guide may form a second auxiliary chamber, wherein the first body may include a first hydraulic line selectively connecting the first auxiliary chamber and the second auxiliary chamber, and a second hydraulic line connecting the first auxiliary chamber and the second auxiliary chamber.

A protrusion portion may be formed in the housing, wherein the first hydraulic line may be closed by protrusion portion when the valve is closed.

The second body may be provided with a hydraulic pressure valve lash adjuster for adjusting a gap of the valve.

The hydraulic pressure valve lash adjuster may include a low pressure chamber formed in the second body, a lash adjusting hydraulic pressure line formed in the housing and the piston guide, a low pressure chamber hydraulic pressure supply line formed in the second body for connecting the low pressure chamber and the lash adjusting hydraulic pressure line, a lash adjuster housing forming high pressure chamber with the second body and connected with the valve, a lash adjuster spring which is disposed between the lash adjuster housing and the second body and elastically supports the lash adjuster housing, a communicating hole communicating the low pressure chamber with the high pressure chamber, a one-way valve which is disposed within the lash adjuster housing and selectively closes the communicating hole, and a one-way valve spring elastically supporting the one-way valve.

The second body may be provided with a mechanical valve lash adjuster for adjusting a gap of the valve.

A swing arm may be disposed between the driving cam and the pump piston, and the pump piston reciprocates by the swing arm.

The main chamber and the first auxiliary chamber may be communicated with by a hydraulic pump hydraulic pressure line.

Reciprocal motion directions of the pump piston and the hydraulic piston may not be parallel each other.

The first auxiliary chamber and the second auxiliary chamber may be connected by a connecting hydraulic line, and a differential pressure valve may be disposed on the connecting hydraulic line.

As described above, an electro-hydraulic variable valve lift apparatus according to various aspects of the present invention may adjust valve lift according to engine operation condition with simple scheme.

An electro-hydraulic variable valve lift apparatus according to various aspects of the present invention may form ramp profile when a valve is closed so as to reduce valve closing impact.

An electro-hydraulic variable valve lift apparatus according to various aspects of the present invention may be provided with a piston guide so that accurate operation may be realized regardless clearance generated in manufacturing process.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION

Figure 1:
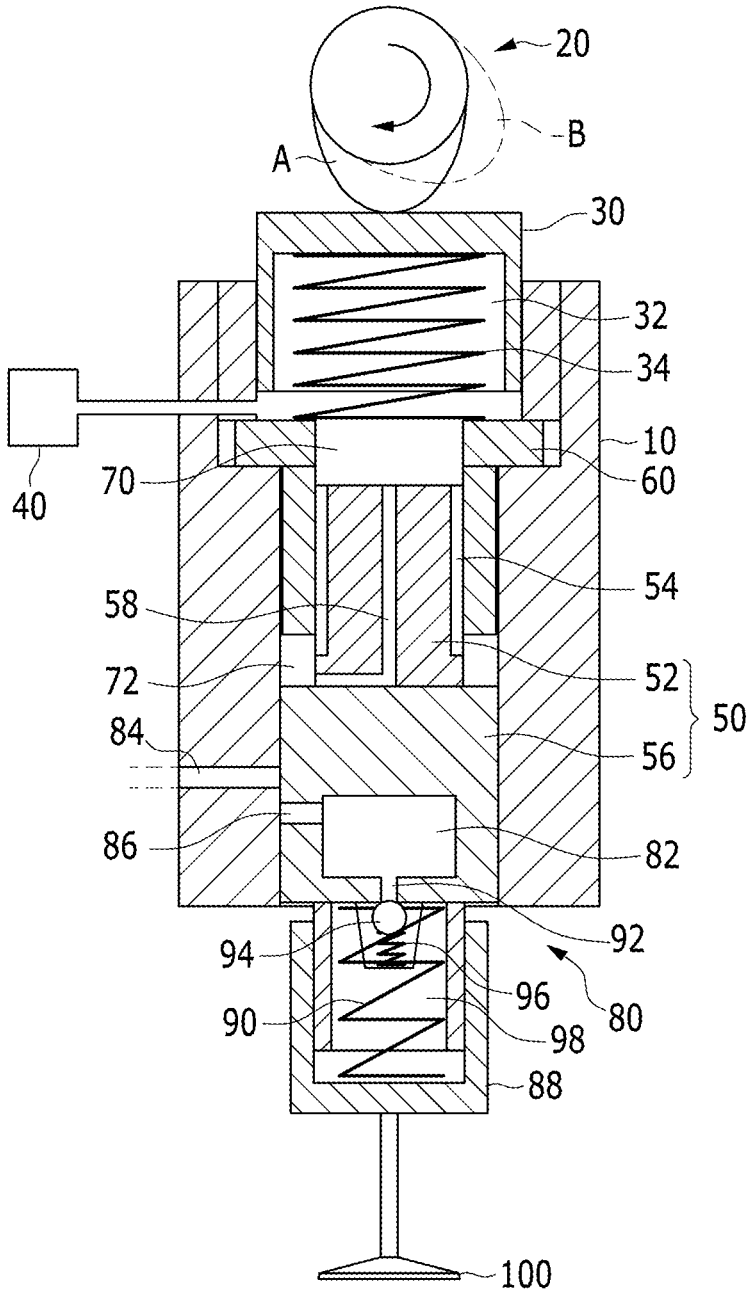
FIG. 1 is a cross-sectional view of an exemplary electro-hydraulic variable valve lift apparatus according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 1 to FIG. 6, an electro-hydraulic variable valve lift apparatus according to various embodiments of the present invention includes a housing 10, a driving cam 20, a pump piston 30 which forms a main chamber 32 with the housing 10, reciprocates within the housing 10 according to rotation of the driving cam 20, and forms hydraulic pressure within the main chamber 32, a pump piston elastic portion 34 which is disposed for elastically supporting the pump piston 30, an oil pressure controller 40 which is communicated with the main chamber 32 in order to control hydraulic pressure within the main chamber 32, a hydraulic piston 50 which is slidably disposed within the housing 10, includes a first body 52 having a first diameter and a second body 56 having a second diameter larger than the first diameter, and is connected with a valve 100, and a piston guide 60 which is disposed between the housing 10 and the hydraulic piston 50 for guiding the hydraulic piston 50.

The piston guide 60 is disposed between the first body 52 and the housing 10. The first body 52 and the housing 10 form a first auxiliary chamber 70, and the second body 56, the housing 10 and the piston guide 60 form a second auxiliary chamber 72. The first body 52 includes a first hydraulic line 54 selectively connecting the first auxiliary chamber 70 and the second auxiliary chamber 72, and a second hydraulic line 58 connecting the first auxiliary chamber 70 and the second auxiliary chamber 72.

The first hydraulic line 54 is closed by the piston guide 60 when the valve 100 is closed.

The second body 56 is provided with a hydraulic pressure valve lash adjuster (HLA) 80 for adjusting a gap of the valve 100.

The hydraulic pressure valve lash adjuster 80 includes a low pressure chamber 82 formed in the second body 56, a lash adjusting hydraulic pressure line 84 formed in the housing 10, a low pressure chamber hydraulic pressure supply line 86 formed in the second body 56 for connecting the low pressure chamber 82 and the lash adjusting hydraulic pressure line 84, a lash adjuster housing 88 forming high pressure chamber 98 with the second body 56 and connected with the valve 100, a lash adjuster spring 90 which is disposed between the lash adjuster housing 88 and the second body 56 and elastically supports the lash adjuster housing 88, a communicating hole 92 communicating the low pressure chamber 82 with the high pressure chamber 98, a one-way valve 94 which is disposed within the lash adjuster housing 88 and selectively closes the communicating hole 92, and a one-way valve spring 96 elastically supporting the one-way valve 94.

Hereinafter, referring to FIG. 1 to FIG. 6, operations of the electro-hydraulic variable valve lift apparatus according to various embodiments of the present invention will be explained.

Figure 2:
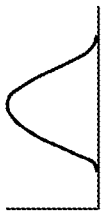
FIG. 2 is operational chart of an exemplary electro-hydraulic variable valve lift apparatus according to the present invention.
Figure 2:
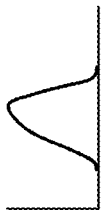
Figure 2:
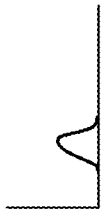
Figure 2:
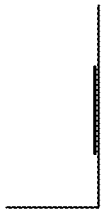
Figure 3:
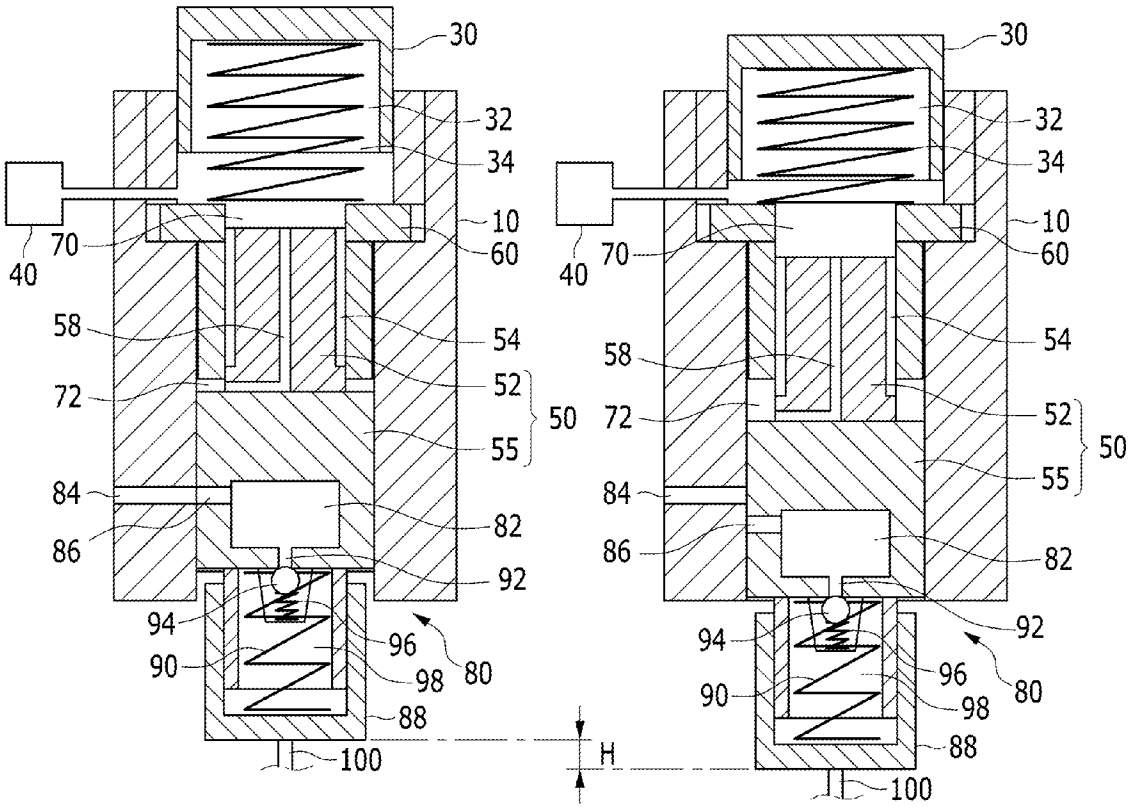
FIG. 3 is a cross-sectional view showing operations of an exemplary electro-hydraulic variable valve lift apparatus according to the present invention.

As shown FIG. 1 to FIG. 3, the oil pressure controller 40 supplies oil to the main chamber 32 and then closed in high load.

The hydraulic piston 50 reciprocates according to rotation of the driving cam 20 and the valve 100 is opened as shown in FIG. 3.

At the moment of opening the valve 100, since the first hydraulic line 54 is closed by the piston guide 60, oil in the first auxiliary chamber 70 is flows into the auxiliary the second chamber 72 though the second hydraulic line 58. After the first hydraulic line 54 is opened, the oil in the first auxiliary chamber 70 is flows into the auxiliary the second chamber 72 though the second hydraulic line 58 and the first hydraulic line 54.

And thus, when the first hydraulic line 54 is closed, ramp is formed so that the valve 100 is opened smoothly. And when the first hydraulic line 54 is opened, the oil in the first auxiliary chamber 70 is flows into the auxiliary the second chamber 72 though the second hydraulic line 58 and the first hydraulic line 54 so that normal valve profile is realized.

When the valve 100 is closed, oil in the second auxiliary chamber 72 flows into the auxiliary the first chamber 70 through the first hydraulic line 54 and the second hydraulic line 58, but when the first hydraulic line 54 is closed by the piston guide 60, the oil in the second auxiliary chamber 72 flows into the auxiliary the first chamber 70 through the second hydraulic line 58.

Thus, when the first hydraulic line 54 is opened, normal valve profile is realized, however when the first hydraulic line 54 is closed the oil in the second auxiliary chamber 72 flows into the auxiliary the first chamber 70 through the second hydraulic line 58 to form the ramp, so that the valve 100 is smoothly closed.

In the high load, ramp profile may be formed according to shape of the cam lobe of the driving cam 20 by adjusting positions of the hydraulic piston 50 and not closing the first hydraulic line 54.

In the middle load of various embodiments of the present invention, the main chamber 32 is filled with oil by the oil pressure controller 40 and then the oil pressure controller 40 is closed.

When the driving cam 20 is positioned near "A" as shown in FIG. 1, the oil pressure controller 40 releases the oil in the main chamber 32.

The oil pressure controller 40 is controlled by an ECU (electronic control unit), and since operations of the oil pressure controller 40 are not necessary for explaining the present invention and thus description of the operation of the oil pressure controller 40 will be omitted.

Operations of opening of the valve 100 are the same as the operations in the high load, and thus detailed explanation will be omitted.

When the valve 100 is closed, oil in the main chamber 32 is released through the oil pressure controller 40 and simultaneously, oil in the second auxiliary chamber 72 flows into the auxiliary the first chamber 70 through the first hydraulic line 54 and the second hydraulic line 58. When then the first hydraulic line 54 is closed by the piston guide 60, the oil in the second auxiliary chamber 72 flows into the auxiliary the first chamber 70 through the second hydraulic line 58.

When the first hydraulic line 54 is opened, the valve 100 is closed faster than in the high load. And when the first hydraulic line 54 is closed, the oil in the second auxiliary chamber 72 flows into the first auxiliary chamber 70 through the second hydraulic line 58 to form a ramp, and thus the valve 100 is smoothly closed.

That is, as shown in FIG. 2, a period of valve opening in the middle load is shorter than a period of valve opening in the high load.

In the low load of various embodiments of the present invention, the main chamber 32 is filled with oil by the oil pressure controller 40 and then the oil pressure controller 40 is closed. When the driving cam 20 is positioned near "B" as shown in FIG. 1, the oil pressure controller 40 releases the oil in the main chamber 32.

Before the driving cam 20 reaches the top position, the oil pressure controller 40 is opened to release hydraulic pressure within the main chamber 32, and thus valve lift is reduced and opening period of the valve 100 is relatively reduced.

In CDA (cylinder deactivation) mode, the oil pressure controller 40 is kept in opening state.

Since hydraulic pressure is not supplied to the main chamber 32, although the driving cam 20 rotates, the pump piston 30 do not moves (lost motion) and the valve 100 is not opened.

The oil pressure controller 40 repeats supplying and releasing of the hydraulic pressure according to operation conditions of the engine, and if timing of releasing the hydraulic pressure is controlled, the electro-hydraulic variable valve lift apparatus according to various embodiments of the present invention realizes various valve profiles.

And also, as described above, the electro-hydraulic variable valve lift apparatus according to various embodiments of the present invention may reduce impact of opening and closing of the valve.

Hereinafter, referring to FIG. 3, operations of the hydraulic pressure valve lash adjuster 80 will be explained.

At the moment the valve 100 is closed, hydraulic pressure is supplied to the low pressure chamber 82 through the lash adjusting hydraulic pressure line 84 and the low pressure chamber hydraulic pressure supply line 86.

If a gap is generated between the valve 100 and a valve seat, hydraulic pressure is supplied from the low pressure chamber 82 to the high pressure chamber 98 so as to adjust the gap during the hydraulic piston 50 reciprocates.

If a gap is in proper range, the one-way valve 94 closes the communicating hole 92 by elastic force of the one-way valve spring 96 and thus the valve 100 is opened constantly.

The hydraulic pressure valve lash adjuster 80 may be formed integrally with the second body 56, and in this case, scheme of the entire electro-hydraulic variable valve lift apparatus may be simple and numbers of the elements and manufacturing cost may be reduced.

Figure 4:
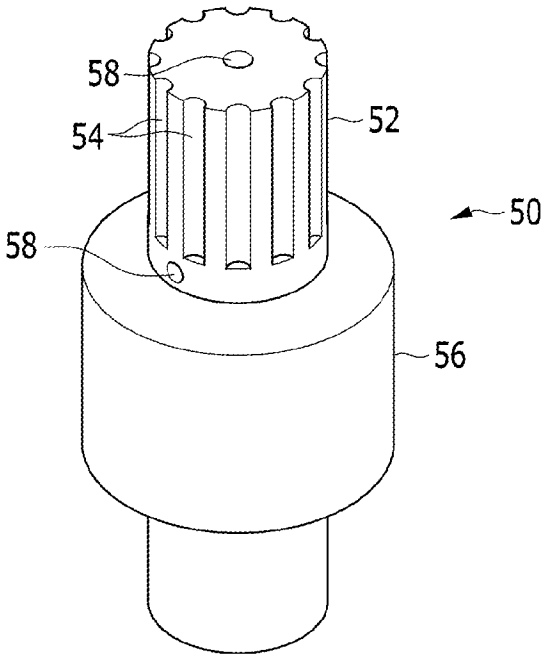
FIG. 4 is a perspective view of a hydraulic piston of an exemplary electro-hydraulic variable valve lift apparatus according to the present invention.
Figure 5:
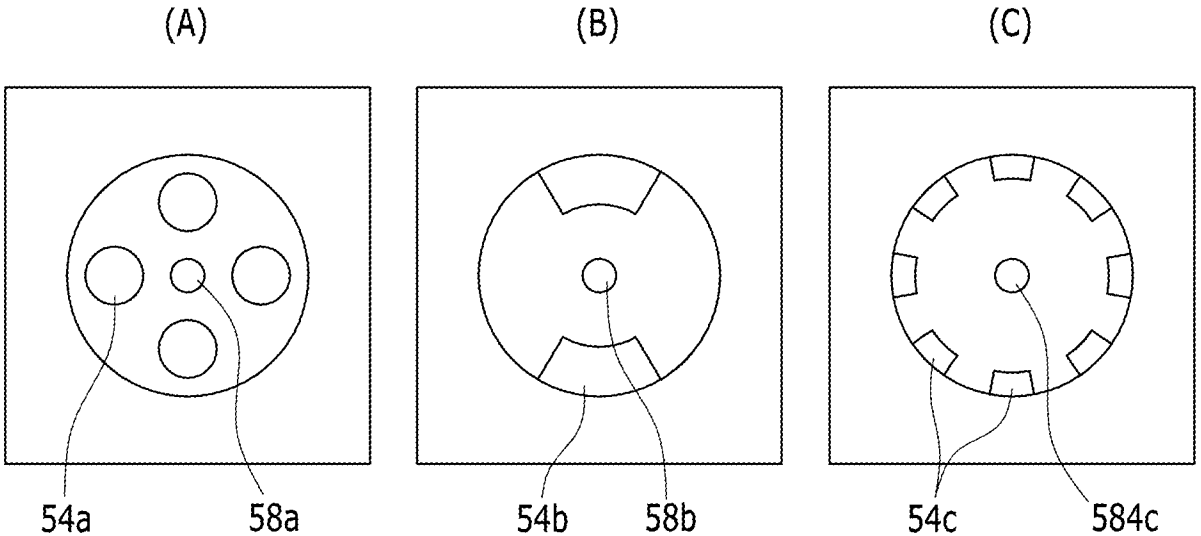
FIG. 5 is a perspective view of exemplary variation of a hydraulic piston of an exemplary electro-hydraulic variable valve lift apparatus.

Referring to FIG. 4 and FIG. 5, the hydraulic piston 50 of the electro-hydraulic variable valve lift apparatus of various embodiments of the present invention may realize a variety hydraulic lines forming multistage hydraulic flowing.

That is, as shown in FIG. 5, the first hydraulic line 54*a* may be formed as plural, and one second hydraulic line 58*a* may be formed. Also, the first hydraulic line may be formed as grooves 54*b* and 54*c* and the second hydraulic line may be formed as holes 58*b* and 58*c*.

And also, the first hydraulic line 54*a*, 54*b*, and 54*c* may be formed having various length holes or grooves for releasing hydraulic pressure in multistage to form a ramp.

Figure 6:
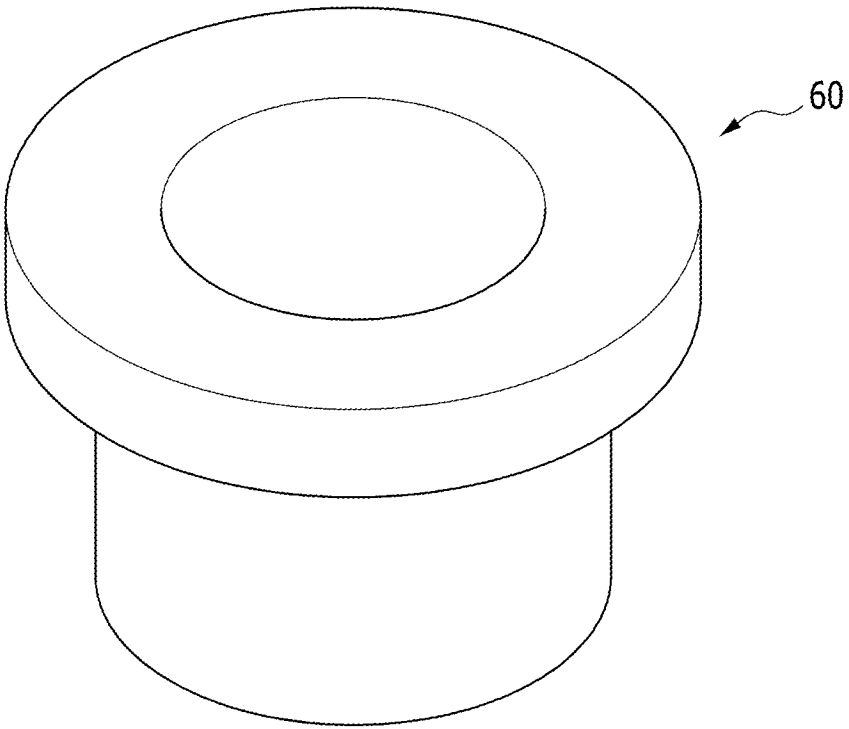
FIG. 6 is a perspective view of a piston guide of an exemplary electro-hydraulic variable valve lift apparatus according to the present invention.

Hereinafter, referring to FIG. 6 and FIG. 7, the piston guide of various embodiments of the present invention will be explained.

When the electro-hydraulic variable valve lift apparatus according to various embodiments of the present invention is operated, the pressure within the main chamber 32, the first auxiliary chamber 70 and the second auxiliary chamber 72 may be about 150 bar.

And thus, precise clearance management is required in manufacturing the electro-hydraulic variable valve lift apparatus.

However, since the hydraulic piston 50 has two exterior diameters of the first body 52 and the second body 56, high cost for precisely making the hydraulic piston 50 is required.

But, if the piston guide 60 is inserted between the housing 10 and the first body 52, the piston guide 60 may compensates manufacturing clearance even though manufacturing centers of the piston guide 60, the housing 10 and the first body 52 are not coaxial. That is optimum level of sealing may be possible by self-aligning.

Figure 7:
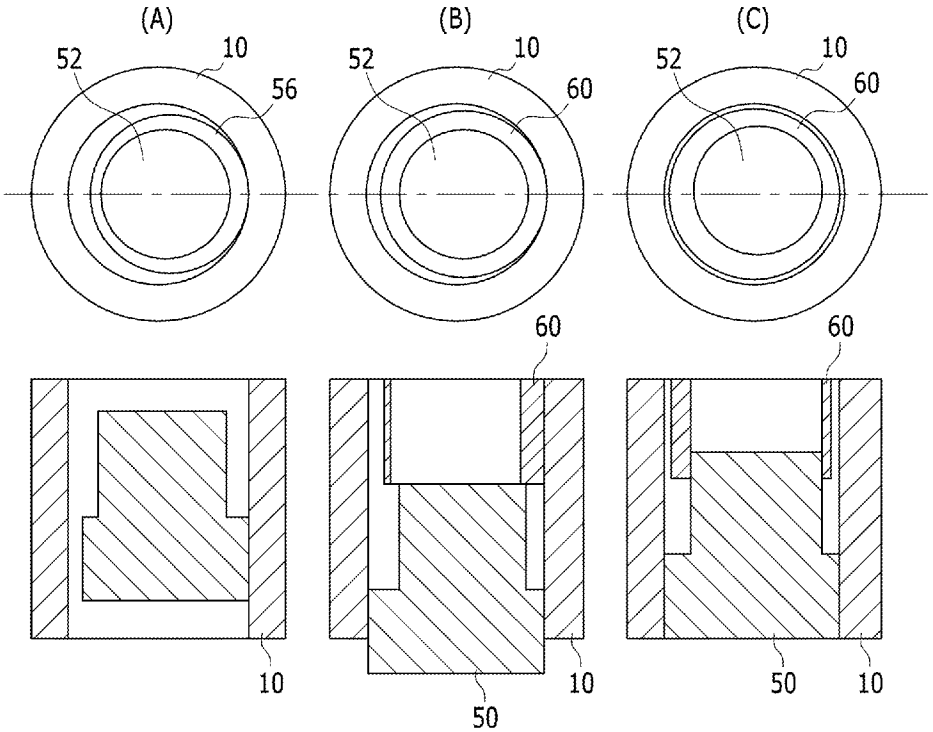
FIG. 7 is a drawing showing self-aligning of a piston guide of an exemplary electro-hydraulic variable valve lift apparatus according to the present invention.

In the FIG. 7, errors of the piston guide 60, the housing 10 and the first body 52 are exaggerated for better understanding.

Figure 8:
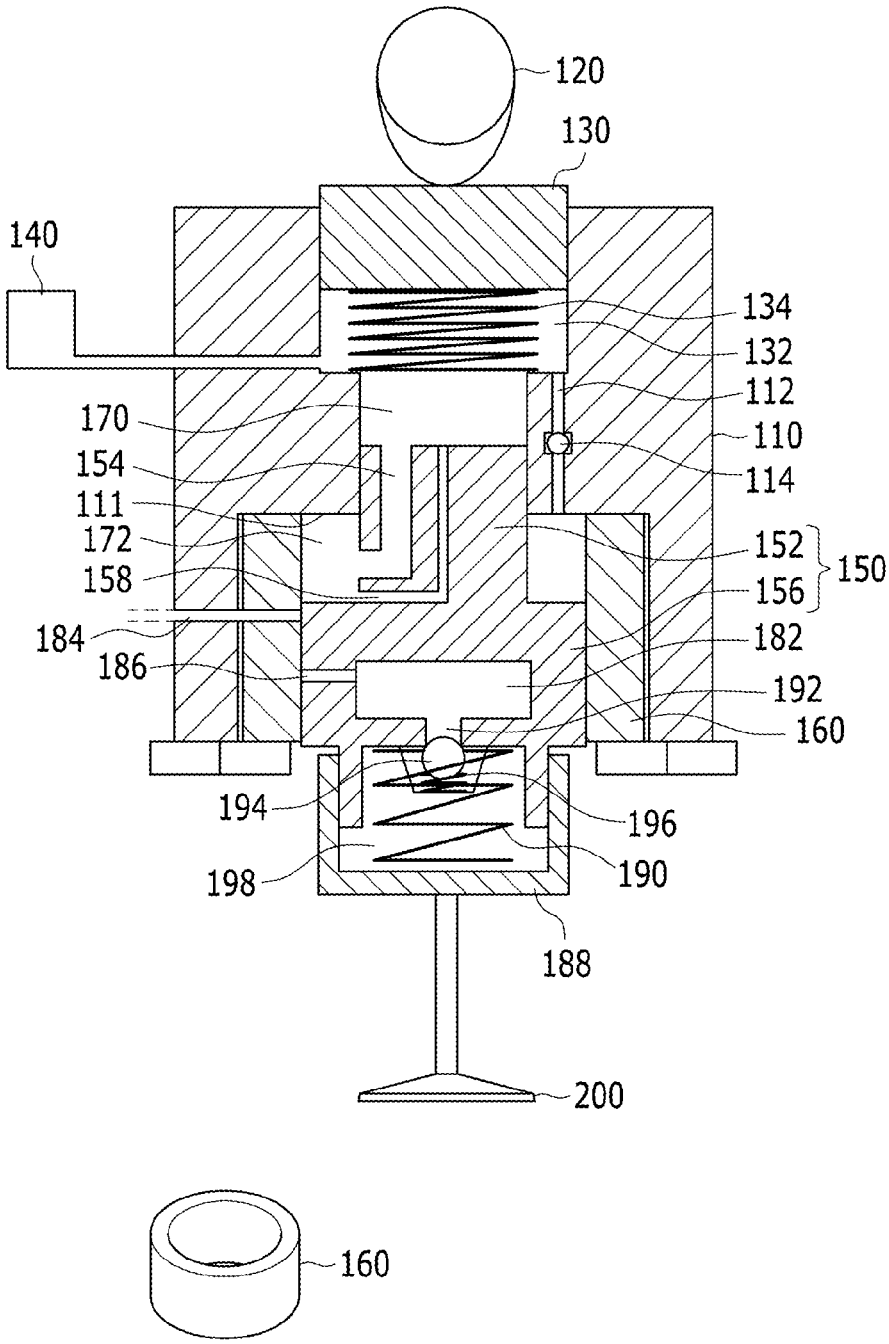
FIG. 8 is a cross-sectional view of an exemplary electro-hydraulic variable valve lift apparatus according to the present invention.

Referring to FIG. 8, an electro-hydraulic variable valve lift apparatus according to various embodiments of the present invention includes a housing 110, a driving cam 120, a pump piston 130 which forms a main chamber 132 with the housing 110, reciprocates within the housing 110 according to rotation of the driving cam 120, and forms hydraulic pressure within the main chamber 132, a pump piston elastic portion 134 which is disposed for elastically supporting the pump piston 130, an oil pressure controller 140 which is communicated with the main chamber 132 in order to control hydraulic pressure within the main chamber 132, and a hydraulic piston 50 which is slidably disposed within the housing 110, includes a first body 152 having a first diameter and a second body 156 having a second diameter larger than the first diameter, and is connected with a valve 200.

The piston guide 160 for guiding the hydraulic piston 50 is disposed between the second body 156 and the housing 110. The first body 152 and the housing 110 form a first auxiliary chamber 170. The second body 156, the housing 110 and the piston guide 160 form a second auxiliary chamber 172. The first body 152 includes a first hydraulic line 154 selectively connecting the first auxiliary chamber 170 and the second auxiliary chamber 172, and a second hydraulic line 158 connecting the first auxiliary chamber 170 and the second auxiliary chamber 172.

A protrusion portion 111 is formed in the housing 110 and the first hydraulic line 152 is formed in be closed by the protrusion portion 111 when the valve 200 is closed.

The second body 156 is provided with a hydraulic pressure valve lash adjuster (HLA) 180 for adjusting a gap of the valve 200.

The hydraulic pressure valve lash adjuster 180 of the illustrated embodiment, similar to that described above, includes a low pressure chamber 182 formed in the second body 156, a lash adjusting hydraulic pressure line 184 formed in the housing 110 and the piston guide 160, a low pressure chamber hydraulic pressure supply line 186 formed in the second body 156 for connecting the low pressure chamber 182 and the lash adjusting hydraulic pressure line 184, a lash adjuster housing 188 forming high pressure chamber 198 with the second body 156 and connected with the valve 200, a lash adjuster spring 190 which is disposed between the lash adjuster housing 188 and the second body 156 and elastically supports the lash adjuster housing 188, a communicating hole 192 communicating the low pressure chamber 182 with the high pressure chamber 198, a one-way valve 194 which is disposed within the lash adjuster housing 188 and selectively closes the communicating hole 192, and a one-way valve spring 196 elastically supporting the one-way valve 194.

The first auxiliary chamber 170 and the second auxiliary chamber 172 are connected by a connecting hydraulic line 112 and a differential pressure valve 114 is disposed on the connecting hydraulic line 112.

The differential pressure valve 114 may exhaust air within the first auxiliary chamber 170 and the second auxiliary chamber 172 and minimize pulsation due to rapid pressure change.

With reference to FIGS. 1-7, an element corresponding to the connecting hydraulic line 112 and the differential pressure valve 114 are not described, however it may be provided to the apparatus illustrated therein.

Operations of the electro-hydraulic variable valve lift apparatus according to the illustrated embodiment of the present invention are similar to the operations of the electro-hydraulic variable valve lift apparatus described above, and thus detailed explanation will be omitted.

Figure 9:
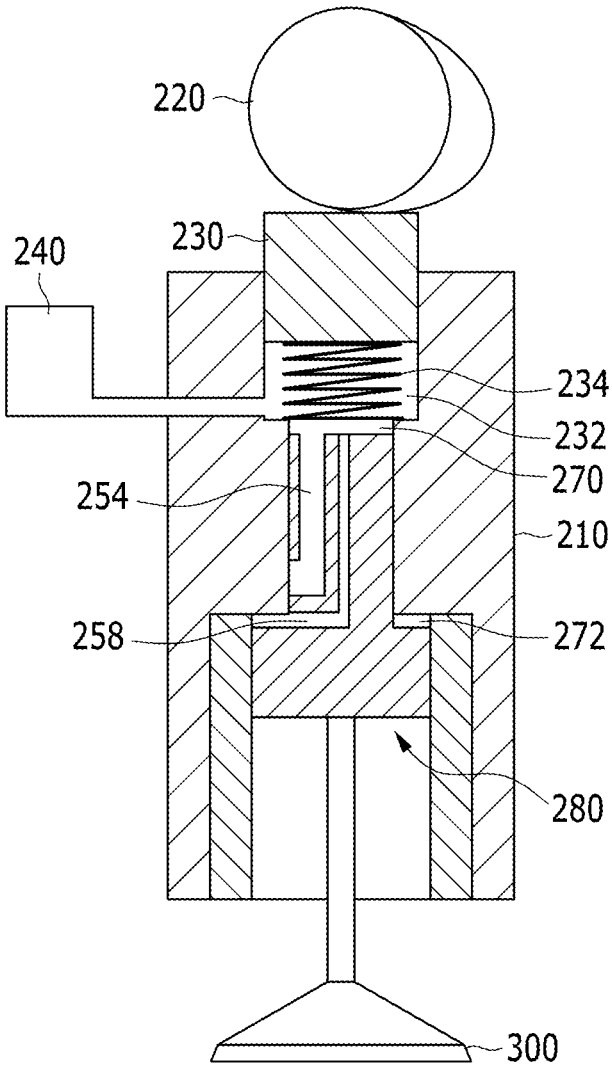
FIG. 9 is a cross-sectional view of an exemplary electro-hydraulic variable valve lift apparatus according to the present invention.

Referring to FIG. 9, the illustrated electro-hydraulic variable valve lift apparatus according to various embodiments of the present invention, similar to that described above, includes a housing 210, a driving cam 220, a pump piston 230 which forms a main chamber 232 with the housing 210, reciprocates within the housing 210 according to rotation of the driving cam 220, and forms hydraulic pressure within the main chamber 232, a pump piston elastic portion 234 which is disposed for elastically supporting the pump piston 230, an oil pressure controller 240 which is communicated with the main chamber 232 in order to control hydraulic pressure within the main chamber 232, and a hydraulic piston 250 which is slidably disposed within the housing 210, includes a first body 252 having a first diameter and a second body 256 having a second diameter larger than the first diameter, and is connected with a valve 300.

The electro-hydraulic variable valve lift apparatus according to various embodiments of the present invention further includes a first auxiliary chamber 270, a second auxiliary chamber 272, a first hydraulic line 254 and the second hydraulic line 258.

A piston guide may be disposed to cover the first body 252 or the second body 256 similar to the electro-hydraulic variable valve lift apparatus according to the embodiments of the present invention described above.

In various embodiments of the present invention, a mechanical valve lash adjuster 280 is provided for adjusting a gap of the valve 300 so as to simplify scheme.

Structure and operation of the mechanical valve lash adjuster 280 are obvious to a person skilled in the art, so that detailed explanation will be omitted.

Operations of the illustrated electro-hydraulic variable valve lift apparatus are similar to the operations of the electro-hydraulic variable valve lift apparatus described above, and thus detailed explanation will be omitted.

Figure 10:
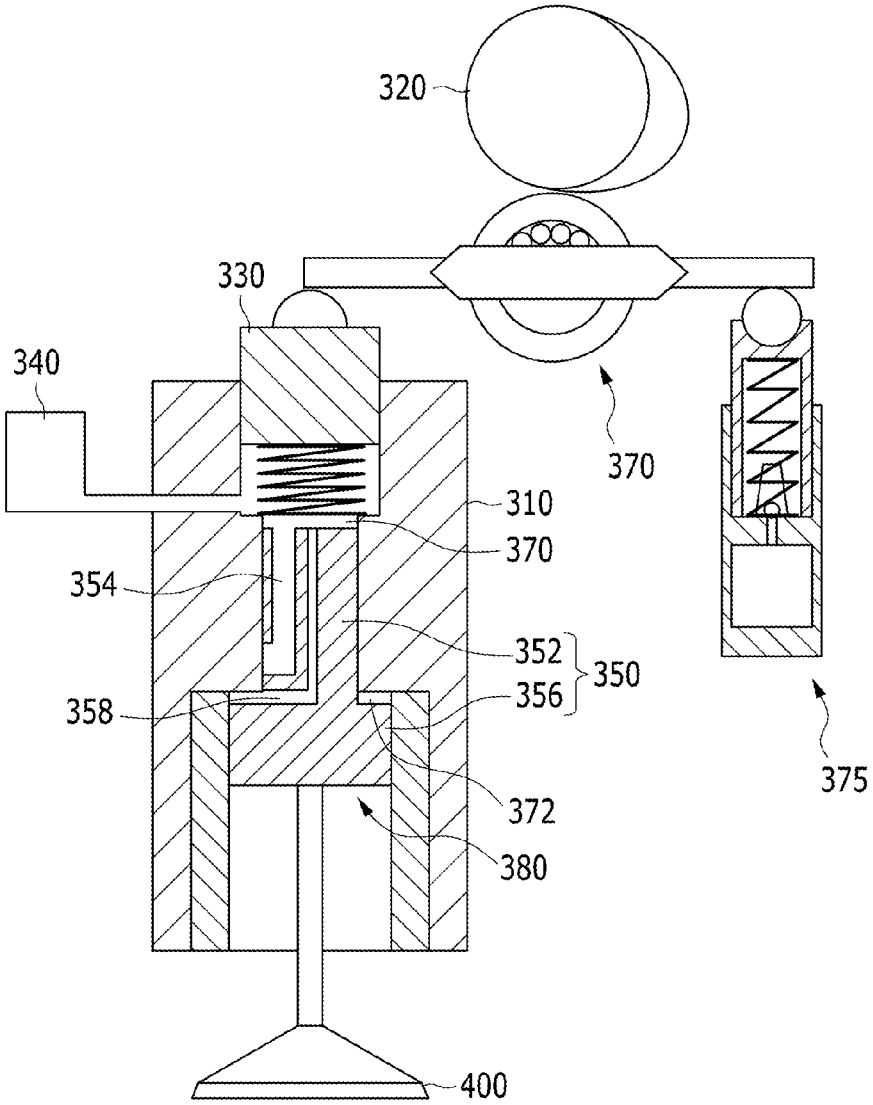
FIG. 10 is a cross-sectional view of an exemplary electro-hydraulic variable valve lift apparatus according to the present invention.

Referring to FIG. 10, the electro-hydraulic variable valve lift apparatus according various embodiments of the present invention, similar to those described above, a housing 310, a driving cam 320, a pump piston 330 which forms a main chamber 332 with the housing 310, reciprocates within the housing 310 according to rotation of the driving cam 320, and forms hydraulic pressure within the main chamber 332, a pump piston elastic portion 334 which is disposed for elastically supporting the pump piston 330, an oil pressure controller 340 which is communicated with the main chamber 332 in order to control hydraulic pressure within the main chamber 332, and a hydraulic piston 350 which is slidably disposed within the housing 310, includes a first body 352 having a first diameter and a second body 356 having a second diameter larger than the first diameter, and is connected with a valve 400.

The electro-hydraulic variable valve lift apparatus according to various embodiments of the present invention further includes a first auxiliary chamber 370, a second auxiliary chamber 372, a first hydraulic line 354 and a second hydraulic line 358.

A piston guide may be disposed to cover the first body 352 or the second body 356 similar to the electro-hydraulic variable valve lift apparatus according to the above described embodiments of the present invention.

A swing arm 370 is disposed between the driving cam 320 and the pump piston 330 for the pump piston 330 to reciprocate by the swing arm 370 and a hydraulic pressure valve lash adjuster 375 or a mechanical valve lash adjuster 375 may be disposed to an end of the swing arm 370.

Operations and scheme of the illustrated electro-hydraulic variable valve lift apparatus are similar to the operations of the electro-hydraulic variable valve lift apparatus described above except for the swing arm 370, and thus repeated explanation will be omitted.

Figure 11:
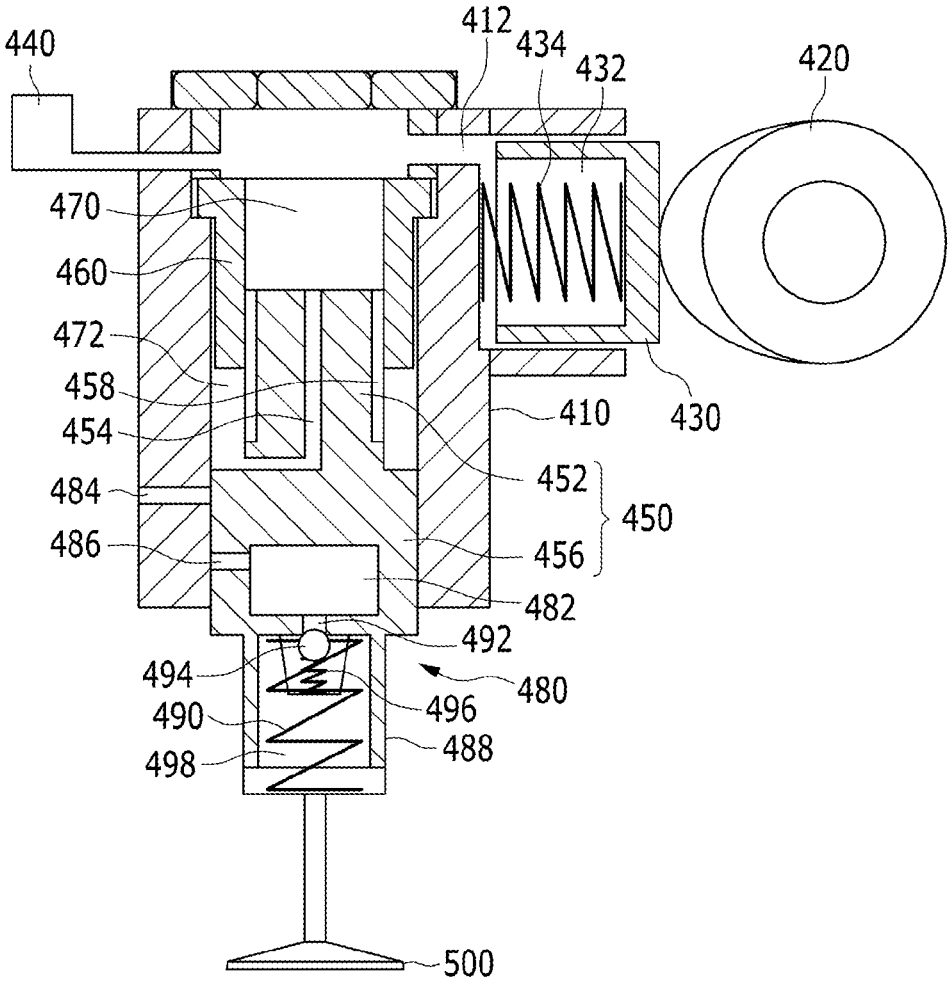
FIG. 11 is a cross-sectional view of an exemplary electro-hydraulic variable valve lift apparatus according to the present invention.

Referring to FIG. 11, the illustrated electro-hydraulic variable valve lift apparatus, similar to those described above, includes a housing 410, a driving cam 420, a pump piston 430 which forms a main chamber 432 with the housing 410, reciprocates within the housing 410 according to rotation of the driving cam 420, and forms hydraulic pressure within the main chamber 432, a pump piston elastic portion 434 which is disposed for elastically supporting the pump piston 430, an oil pressure controller 440 which is communicated with the main chamber 432 in order to control hydraulic pressure within the main chamber 432, and a hydraulic piston 450 which is slidably disposed within the housing 410, includes a first body 452 having a first diameter and a second body 456 having a second diameter larger than the first diameter, and is connected with a valve 500.

The electro-hydraulic variable valve lift apparatus according to various embodiments of the present invention further includes a first auxiliary chamber 470, a second auxiliary chamber 472, a first hydraulic line 454 and a second hydraulic line 458.

The electro-hydraulic variable valve lift apparatus according to various embodiments of the present invention further includes a piston guide 460 disposed between the first body 452 and the housing 410.

The piston guide 460 may be disposed between the second body 456 and the housing 410 similar to those described above.

In various embodiments of the present invention, a hydraulic pump hydraulic pressure line 412 is formed between the main chamber 432 and the first auxiliary chamber 470 to be communicated with each other.

In this case, since reciprocal motion directions of the pump piston 430 and the hydraulic piston 450 do not need to be parallel each other, as shown in FIG. 11, the pump piston 430 may be vertically mounted to the housing 410 regardless positions of the driving cam 420.

And thus, design freedom of a valve train, a cylinder head and so on may be improved.

The electro-hydraulic variable valve lift apparatus according to various embodiments of the present invention further includes a hydraulic pressure valve lash adjuster 480 disposed to the second body 456 for adjusting a gap of the valve 400.

The illustrated hydraulic pressure valve lash adjuster 480, similar to those described above, includes a low pressure chamber 482, a lash adjusting hydraulic pressure line 484, a low pressure chamber hydraulic pressure supply line 486, a high pressure chamber 498, a lash adjuster housing 488, a lash adjuster spring 490, a communicating hole 492, a one-way valve 494, and a one-way valve spring 496.

Operations and scheme of the illustrated electro-hydraulic variable valve lift apparatus are similar to the operations of the electro-hydraulic variable valve lift apparatus described above, and thus repeated explanation will be omitted.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydraulic variable valve lift apparatus comprising:

a housing;

a driving cam;

a pump piston which forms a main chamber with the housing, reciprocates within the housing according to rotation of the driving cam, and forms hydraulic pressure within the main chamber;

a pump piston elastic portion disposed for elastically supporting the pump piston;

an oil pressure controller communicating with the main chamber in order to control hydraulic pressure within the main chamber;

a hydraulic piston slidably disposed within the housing, includes a first body having a first diameter and a second body having a second diameter larger than the first diameter, and is operably connected with a valve; and a piston guide disposed between the housing and the hydraulic piston for guiding the hydraulic piston;

wherein:

the piston guide is disposed between the first body and the housing;

the first body and the housing form a first auxiliary chamber; and the second body, the housing and the piston guide form a second auxiliary chamber;

wherein the first body comprises:

a first hydraulic line selectively connecting the first auxiliary chamber and the second auxiliary chamber; and a second hydraulic line continuously connecting the first auxiliary chamber and the second auxiliary chamber; and wherein the first hydraulic line is closed by the piston guide when the valve is closed.

2. The electro-hydraulic variable valve lift apparatus of claim 1, wherein the second body is provided with a hydraulic pressure valve lash adjuster for adjusting a gap of the valve.

3. The electro-hydraulic variable valve lift apparatus of claim 2, wherein the hydraulic pressure valve lash adjuster comprises:

a low pressure chamber formed in the second body;

a lash adjusting hydraulic pressure line formed in the housing;

a low pressure chamber hydraulic pressure supply line formed in the second body for connecting the low pressure chamber and the lash adjusting hydraulic pressure line;

a lash adjuster housing forming high pressure chamber with the second body and operably connected with the valve;

a lash adjuster spring disposed between the lash adjuster housing and the second body and elastically supports the lash adjuster housing;

a communicating hole communicating the low pressure chamber with the high pressure chamber;

a one-way valve disposed within the lash adjuster housing and selectively closes the communicating hole; and a one-way valve spring elastically supporting the one-way valve.

4. The electro-hydraulic variable valve lift apparatus of claim 1, wherein the second body is provided with a mechanical valve lash adjuster for adjusting a gap of the valve.

5. The electro-hydraulic variable valve lift apparatus of claim 1, wherein a swing arm is disposed between the driving cam and the pump piston, and the pump piston reciprocates by the swing arm.

6. The electro-hydraulic variable valve lift apparatus of claim 1, wherein the main chamber and the first auxiliary chamber are communicated with by a hydraulic pump hydraulic pressure line.

7. The electro-hydraulic variable valve lift apparatus of claim 6, wherein reciprocal motion directions of the pump piston and the hydraulic piston are not parallel each other.

8. The electro-hydraulic variable valve lift apparatus of claim 1, wherein:

the first auxiliary chamber and the second auxiliary chamber are connected by a connecting hydraulic line; and a differential pressure valve is disposed on the connecting hydraulic line.

9. The electro-hydraulic variable valve lift apparatus of claim 1, wherein a protrusion portion is formed in the housing, wherein the first hydraulic line is closed by protrusion portion when the valve is closed.

10. The electro-hydraulic variable valve lift apparatus of claim 1, wherein a lower end of the first hydraulic line disposed in the second auxiliary chamber is disposed higher than a lower end of the second hydraulic line disposed in the second auxiliary chamber.

* * * * *